US006246563B1

(12) United States Patent
Olsson

(10) Patent No.: US 6,246,563 B1
(45) Date of Patent: Jun. 12, 2001

(54) DOUBLE-ACTING ELECTROMAGNETIC ACTUATOR

(75) Inventor: Johan Olsson, Åmål (SE)

(73) Assignee: Swedish Control Systems Aktiebolag (SE)

( * ) Notice: Subject to any disclaimer, the term of this patent is extended or adjusted under 35 U.S.C. 154(b) by 0 days.

(21) Appl. No.: 09/297,525

(22) PCT Filed: Sep. 2, 1998

(86) PCT No.: PCT/SE98/01564

§ 371 Date: May 3, 1999

§ 102(e) Date: May 3, 1999

(87) PCT Pub. No.: WO99/14768

PCT Pub. Date: Mar. 25, 1999

(30) Foreign Application Priority Data

Sep. 4, 1997 (SE) ..... 9703198

(51) Int. Cl.[7] ..... H01F 7/06

(52) U.S. Cl. ..... 361/160; 361/210; 335/226

(58) Field of Search ..... 335/100, 226, 335/245, 223, 224; 361/159, 160, 206, 210

(56) References Cited

U.S. PATENT DOCUMENTS

| | | | | |
|---|---|---|---|---|
| 1,066,081 | | 7/1913 | Coleman . | |
| 1,711,285 | | 4/1929 | Petersen . | |
| 1,792,512 | * | 2/1931 | Siegmund . | |
| 2,736,843 | * | 2/1956 | Douglas et al. | 317/156 |
| 2,989,668 | * | 6/1961 | Parisoe | 317/176 |
| 3,524,111 | * | 8/1970 | Maecker et al. | 317/155.5 |
| 3,585,458 | * | 6/1971 | Yoshimura | 335/149 |
| 4,032,823 | * | 6/1977 | Arvisenet et al. | 361/194 |
| 4,598,178 | * | 7/1986 | Rollins | 179/115.5 VC |

* cited by examiner

*Primary Examiner*—Fritz Fleming
(74) *Attorney, Agent, or Firm*—George T. Marcou; Kilpatrick Stockton LLP

(57) ABSTRACT

The invention relates to an electromagnetic actuator for a rapid linear motion with a limited length of stroke. The electromagnetic actuator includes a stationary arranged first coil (1, 6) and a second movable coil (2), with the winding of the stationary coil connected to controllable power source (7) and the winding of the movable coil is short-circuited without any galvanic connection to an external power source The ends of the winding of the movable coil of the electromagnetic actuator is short-circuited via a rectifier element (9), preferably a diode. The diode allows a current to be developed in one direction only in the winding of the second coil, said current being induced from an electromagnetic field generated by a current through the first coil. In this manner is a double-acting electromagnetic actuator with very low weight obtained, resulting in very rapid response and high reliability, due to the lack of any external electrical connections to the movable coil.

7 Claims, 3 Drawing Sheets

DOUBLE-ACTING ELECTROMAGNETIC ACTUATOR

Figure 1:
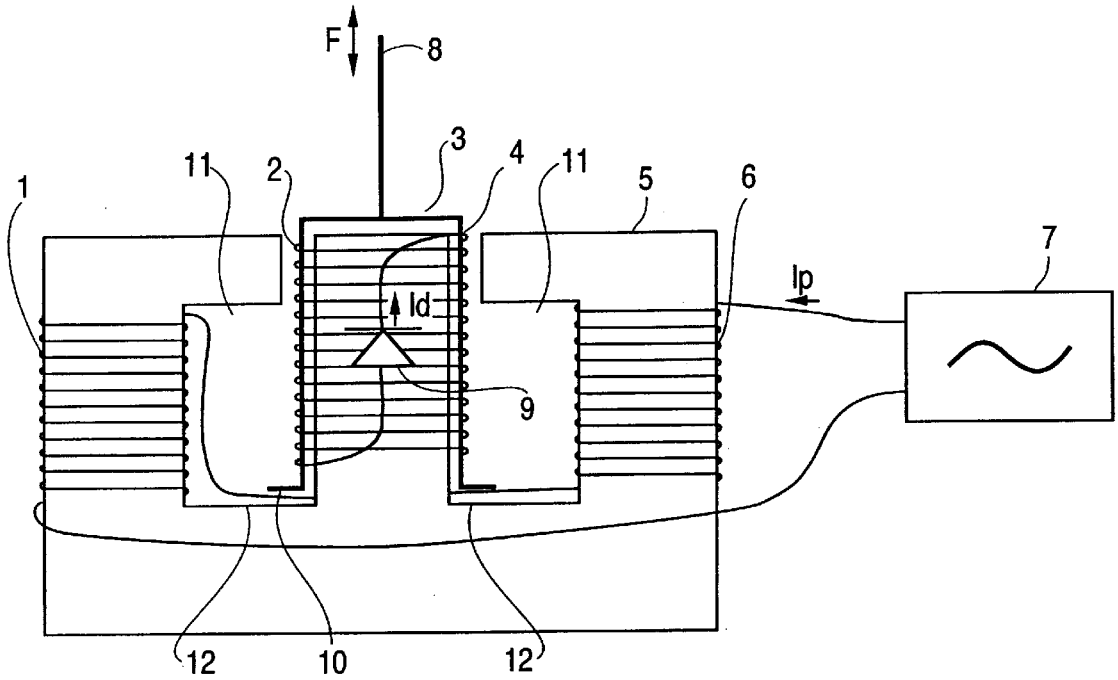

Present invention relates to an electromagnetic actuator having a rapid linear motion with a moderate length of stroke.

STATE OF THE ART

It is previously known with coils being movable under the influence of magnetic fields. Such an example could be found in loud speakers with stationary permanent magnets having a movable voice coil arranged in the magnetic field induced by the permanent magnet. The winding of the voice coil is connected to an external power source, and by current control the coil could be given the intended motion. A drawback with this solution is that the external connections are movable and subject to a potential interruption.

In U.S. Pat. No. 5294850 is further known a device wherein an electromagnetic field-effect could launch missiles. In this solution a stationary coil is used, which affects a coil arranged on or in contact with the missile to be launched. The movable coil is lacking any external connections and the winding is short-circuited, or alternatively divided into several coil segments, and wherein the electromagnetic field is controlled by the current in the stationary coil.

In U.S. Pat. No. 1066081 is shown in an alternative embodiment, i.e. FIGS. 4 and 5, a relay having a stationary and a movable coil. The winding of the movable coil is connected to a stationary circuit breaker, and the movable coil is affected in a controlled manner in one direction by said circuit breaker and the magnetic field induced from the stationary coil.

A conventional solution, in order to obtain a double-acting actuator, utilize a stationary solenoid and a movable iron core, which iron core is forced towards a first end position using a return spring.

When the iron core is activated towards the second end position, then the force from the electromagnetic field must overcome the counteracting force from the return spring and initiate movement of the mass of the iron core. This will bring about a decrease in response, due to the rather large mass of the actuator and need to overcome the force from the return spring.

OBJECT OF THE INVENTION

The object of the invention is to obtain an electromagnetic actuator useful for most situations where a double acting and rapid movement with a moderate length of stroke is requested. Another object is to obtain an electromagnetic actuator with a quick response, yet another object is to obtain an electromagnetic actuator lacking any electrical connections to the movable part of the electromagnetic actuator.

An object with a further refined embodiment is to be able to obtain a feed-back signal of the position of the actuator, whereby an improved control with increased accuracy of movement of the actuator could be obtained.

SHORT DESCRIPTION OF THE INVENTION.

The inventive electromagnetic actuator is an electromagnetic actuator for a rapid linear motion with a limited length of stroke, with a stationary arranged first coil and a second movable coil, wherein the winding of the stationary coil is connected to a controllable power source. The winding of the movable coil is short-circuited without any galvanic contact with external power sources in that the ends of the winding of the movable coil are short-circuited via a rectifier element, which rectifier element only allows current to be developed in one direction in the winding of the movable coil, which current in the movable coil is induced from an electromagnetic field generated by a current through the stationary coil The inventive electromagnetic actuator is a double acting electromagnetic actuator that can be obtained with less dead weight of all moving parts and which will give a rapid response of the actuator. The electromagnetic actuator will also exhibit a lack of any electrical connections to the movable part, which will give a high order of reliability.

Other distinguishing features and advantages of the invention will be evident from the characterising parts of the claims, and following description of embodiments. The description of embodiments are made by reference to figures from the following list of figures.

LIST OF FIGURES

Figure 2:
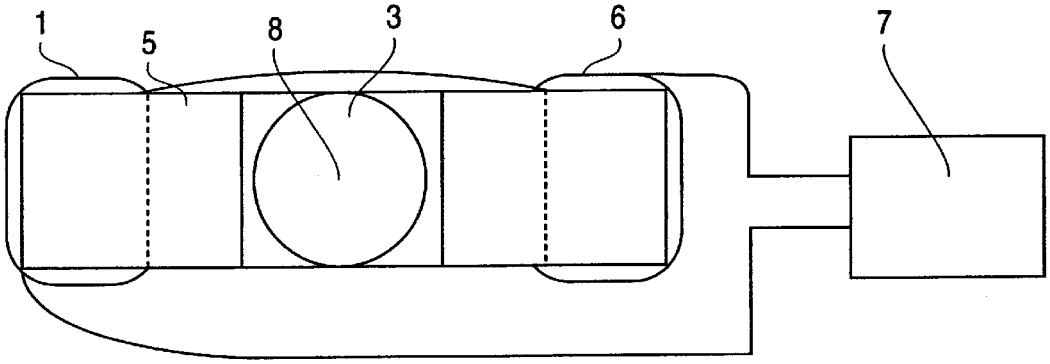
Figure 3A:
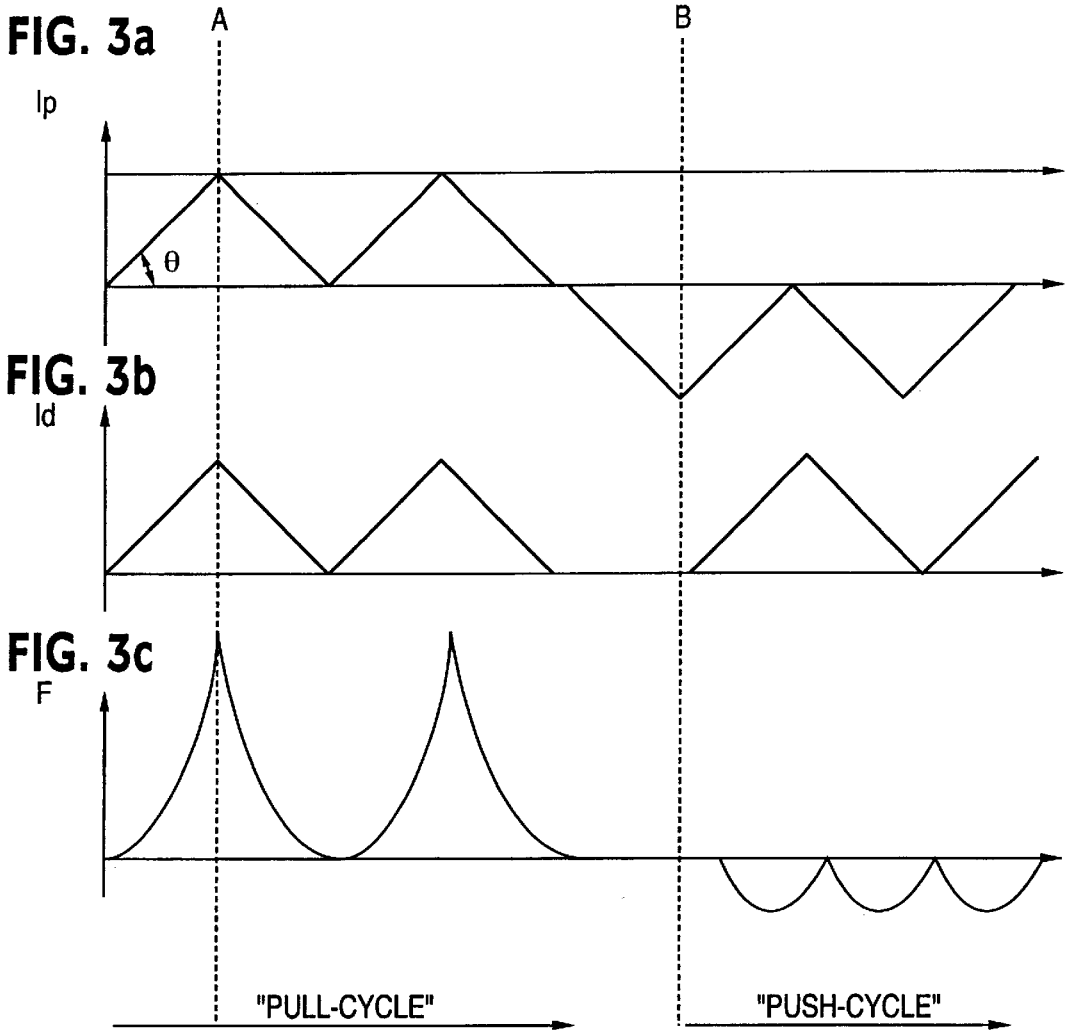
Figure 4:
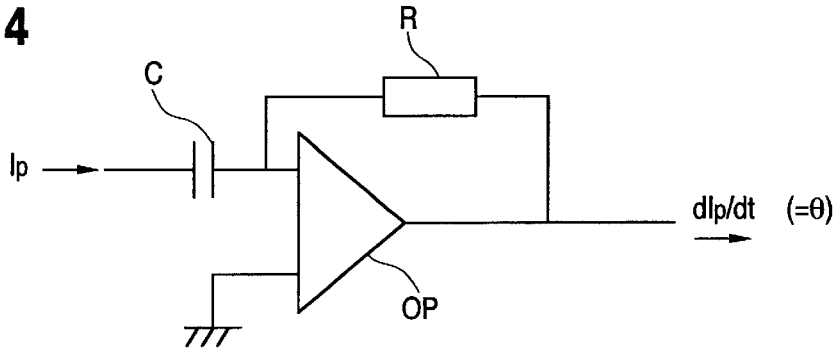
Figure 5:
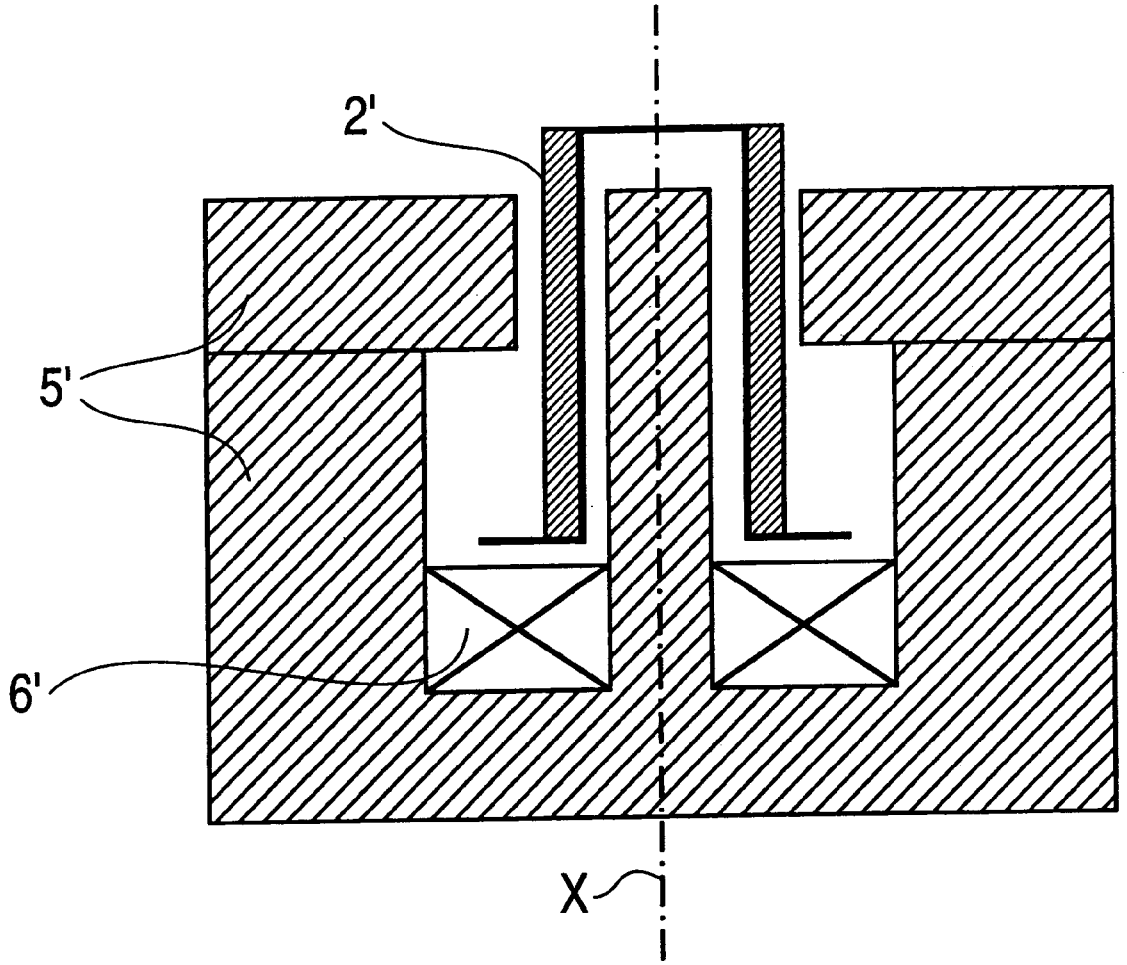

FIG. 1. shows in a side view an inventive electromagnetic actuator,

FIG. 2 shows the electromagnetic actuator in FIG. 1 as seen from above,

FIG. 3*a*, 3*b* and 3*c* shows respectively the current through the stationary coil, the current through the movable coil and the force induced by the movable coil, FIG. 4. shows an analog circuit for detection of the position of the movable coil, FIG. 5, shows an alternative solution for the actuator.

DESCRIPTION OF EMBODIMENTS

In FIG. 1 is shown the inventive electromagentic actuator. A stationary coil 1,6 is wound upon a core 5, which preferably is a ferrite-core. In this embodiment the stationary coil is divided into two coil segments connected serially, each wound around one leg of the core having two legs in parallel. In an alternative embodiment the core could be manufactured by laminated sheet metal. But a ferrite-core, even though more expensive, is preferred.

A controllable power source 7 is connected to the stationary coil, controlling the current $I_p$ through the stationary coil.

A coil 2 movable in relation to the stationary coil, is wound on a coil former 3. The coil former is preferably guided by a third leg of the core 5, which third leg is in parallel with the legs upon which the stationary coil is wound, and said third leg located between these two legs.

The coil former and the coil wound thereupon is located in an air gap 4 between the two legs of the stationary coil.

In order to retain the movable coil on the coil guiding leg of the core, is the coil former 3 is equipped with a flange 10 at the lower part thereof as shown in FIG. 1. The upper and lower surface of the flange 10 acts as a first and second stop lug, each interacting with a first and second stop lug respectively of the core. The first stop lug 11 of the core is formed by two radially and inwardly directed protrusions of the core legs, upon which the core segments are wound. The first stop lugs 11 limiting the movement of the movable coil in a first protruded position.

The second stop lug 12 of the core is limiting the movement of the movable coil in a second retracted end-position of the movable coil 2 in relation to the stationary coil 1,6.

In the embodiment shown the coil former cylindrical, apparent in FIG. 2, is with an integrated actuator arm 8. The coil former could alternatively also be given other shapes, for example with a rectangular or polygonal cross sections without departing from the invention.

The coil wound at the movable coil former is short-circuited via a diode 9, which diode only conducts current in one direction. This diode could be substituted with any equivalent type of component, which component only will conduct current in one direction in the second movable coil, which current is induced from an electromagnetic field generated by current through the first and stationary coil.

The function of the electromagnetic actuator is described in detail with reference to the current-and force-graphs shown in FIG. 3*a*–3*c* as a function of time. These principle graphs have been obtained after practical tests of an embodiment corresponding to the embodiment shown in FIG. 1. In FIG. 3*a* is shown the current $I_P$ through the stationary coil 1,6, which current is controlled in an conventional manner via the connected power source 7.

In FIG. 3*b* is shown the current through the movable coil 3, which current is induced by the electromagnetic field generated by the stationary coil. In FIG. 3*c* is shown the force F obtained at the actuator-arm 8, when the movable coil 2 is influenced by the magnetic field in the air-gap 4.

In the embodiment shown, a first "pull cycle" is defined, corresponding to a movement of the movable coil inwards, i.e. in a downward direction in FIG. 1. At start of the pull-cycle the current $I_P$ is initiated in the stationary coil 5,6, which generates a magnetic field that in turn will induce a current $I_d$ in the movable coil 4. The current in the stationary coil reaches its maximum value at the point of time A, at which time also the current in the movable coil and the force obtained from the actuator an 8 reaches maximum values respectively. Shortley after the point of time A reduction of the current $I_P$ is initiated through the stationary coil. The reduction will result in that also the current through the movable coil will decrease. The force F developed will follow the equation;

$$F=B\cdot I_d\cdot L,$$

where B is the strength of the magnetic field and L the length of the conductor located in the magnetic field, and where a force is developed during the entire cycle.

In order to maintain a continuous application of a force towards the retracted position, this sequence is repeated continuously. In the figure, however, only two sequences during the pull cycle are shown.

In the "push-cycle", corresponding to a movement of the movable coil outwards, i.e. in a upward direction in FIG. 1, a current is initiated in the stationary coil in the reversed direction. This current will generate a magnetic field having an opposite direction in relation to the pull-cycle, and which magnetic field is likely to induce a current in the movable coil when the field and current declines. Immediately after the point of time B, the current through the stationary coil is subject to decrease, whereby the magnetic field starts to induce a current through the movable coil in the same direction as the current induced during the pullkycle. A force F, following the same force equation as mentioned earlier ($F=B\cdot I_d\cdot L$), is obtained, and directed in the opposite direction in relation to the pull-cycle, due to the change of spin of B. In the figure, however, only two sequences during the push-cycle are shown.

Tests have also proven that a determination of the position of the movable coil could be made by detection of θ, see FIG. 3, which corresponds to $dI_p dt$, i.e. the first order derivative value of the current through the stationary winding. The parameter θ decreases with decreasing exposure of the movable coil in the magnetic field. This determnination of position could preferably be performed by means of conventional analog circuitry.

In FIG. 4 is shown in principle such basic analog circuitry. In this embodiment is used a simple operational amplifier OP, which is connected through the resistance R and the capacitor C, such that the input signal $I_p$ produce the output signal $dI_p/dt$. In practical implementations will the circuitry will require some supplementing logic in order to obtain a correct analysis and sampling of the signal.

The inventive electromagnetic actuator could also in a further improved embodiment be controlled as of position, where the processed signal of position is used as a feed-back signal of the position. By modulation of the pulse-width during the pull- and the push-cycle, the actuator could be imparted any arbitrary position between the two end positions.

In order to ensure that a predetermined lowest order of force shall be obtained from the actuator, the current lp through the primary coil could be controlled at a higher level in terms of absolute value. i.e. at a level where $I_p$ is not allowed to be reduced to a zero-level. This could contribute to an improved efficiency.

The invention could within the scope of the claims be modified in a number of ways. As an example the core could be given another shape and the stationary coil could have only one coil segment. In FIG. 5 is an example of an embodiment adapted for production, where the primary winding 6' is wound upon the center leg of the coil 5', concentric with the secondary winding 2'. This embodiment will give an improved transformer coupling, where the core could be given a form axially symmetrical in relation to axis X. At the same time the primary winding 6' is given a improved protective enclosure.

In case of an implementation in power demanding applications, the rectifier element could be replaced by MOSFET technology, in order to reduce any power losses through the rectifier element. By implementation of MOSFET technology the potential drop in the conducting direction could be reduced from an order of 0.7 volts to only a fraction thereof.

What is claimed is:

1. Electromagnetic actuator for a rapid linear motion with a limited length of stroke, with a stationary arranged first coil and a second movable coil, wherein the winding of the stationary coil is connected to controllable power source and the winding of the movable coil is short-circuited without any galvanic contact with external power sources characterized in that the ends of the winding of the movable coil are short-circuited via a rectifier element which rectifier element only allows current to be developed in one direction in the winding of the movable coil, which current in the movable coil is induced from an electromagnetic field generated by a current through the stationary coil.

2. Electromagnetic actuator according claim 1 characterized in that the rectifier element is a diode.

3. Electromagnetic actuator according claim 1 characterized in that the first coil is wound upon a core, and wherein the second movable coil is arranged upon a coil former which in turn is arranged with an air gap to and guided by a protrusion of the core.

4. Electromagnetic actuator according claim 2 characterized in that the rectifier element which rectifies the current of the movable coil is arranged integrated with the coil former and the winding of the movable coil.

5. Electromagnetic actuator according claim 4 characterized in that the coil former upon which the second movable coil is firmly arranged, also includes an integrated actuator arm.

6. Electromagnetic actuator according claim 5 characterized in that the coil former includes a first and second stop lug which in cooperation with a first and second stop lug respectively upon the core, will limit the movement of the movable coil between a first and second end position in relation to the first stationary coil.

7. Electromagnetic actuator according any of the proceeding claims characterized in that the winding of the first coil of the actuator is connected to detection means by which a detection of a value corresponding to the speed of change of the current through the winding could be made.

* * * * *